United States Patent [19]

Molitor

[11] 3,952,882

[45] Apr. 27, 1976

[54] DEVICE FOR DELIVERING PADS TO A BUNDLING MACHINE

[75] Inventor: Edwin A. Molitor, Miami Township, Clermont County, Ohio

[73] Assignee: Multifold-International, Inc., Milford, Ohio

[22] Filed: Aug. 21, 1974

[21] Appl. No.: 499,180

[52] U.S. Cl. ..... 214/6 D; 93/93 D; 214/6 M; 221/10; 221/13; 271/3.1; 271/265

[51] Int. Cl.[2] ..... B65G 60/00

[58] Field of Search ..... 214/6 D, 6 M, 8.5 G; 271/3.1, 110, 111, 265; 221/10, 11, 13; 93/93 R, 93 D, 93 DP

[56] References Cited

UNITED STATES PATENTS

| | | | |
|---|---|---|---|
| 1,915,376 | 6/1933 | Moone | 93/93 DP |
| 2,486,415 | 11/1949 | Huntar | 221/10 X |
| 3,027,021 | 3/1962 | Kramer | 214/8.5 G |
| 3,194,126 | 7/1965 | Larsson | 271/3.1 X |
| 3,469,834 | 9/1969 | Stange et al. | 271/10 |
| 3,635,463 | 1/1972 | Stobb | 271/3.1 X |
| 3,674,160 | 7/1972 | Gutowski | 221/10 X |
| 3,705,719 | 12/1972 | Polit et al. | 271/3.1 X |

*Primary Examiner*—Robert J. Spar
*Assistant Examiner*—L. J. Paperner
*Attorney, Agent, or Firm*—James W. Pearce; Roy F. Schaeperklaus

[57] ABSTRACT

A device for delivering pads to a machine for bundling flat articles. The device includes a first pad hopper, a first conveyor which draws pads from the first pad hopper, a second pad hopper receiving pads from the first conveyor, and a second conveyor which withdraws pads from the second pad hopper. The first conveyor is driven when the level of the pads in the second hopper falls below a predetermined level to maintain the level of pads in the second hopper. A switch operator extends into the path of pads being advanced from the second hopper by the second conveyor and actuates a switch to stop the second conveyor when a pad has been advanced to a predetermined pad delivery position. The pad is withdrawn from the pad delivery position when a pad is required by the bundling machine and is delivered to the bundling machine. A frame on which the first conveyor operates can be adjusted to swing a discharge end thereof toward and away from the second hopper to insure proper delivery of pads to the second hopper.

7 Claims, 20 Drawing Figures

DEVICE FOR DELIVERING PADS TO A BUNDLING MACHINE

This invention relates to a machine for arranging flat articles in a bundle. More particularly, this invention relates to a device for use in connection with an article bundling machine for delivering an end pad to the bundling machine when required as flat articles are assembled in the bundling machine.

An object of this invention is to provide a machine which is arranged to deliver a pad to a bundling machine on demand by the bundling machine.

A further object of this invention is to provide a pad delivering device which can receive groups of pads intermittently and which delivers the pads one at a time to a station from which a single pad can be delivered when required.

A further object of this machine is to provide such a pad delivering device which includes a first hopper structure in which pads can be placed at intervals and a second hopper to which the pads are delivered from the first pad hopper in such arrangement that a single pad can quickly be made available when required.

A further object of this invention is to provide such a machine in which the lowest pad of the group of pads in the second hopper rests on a belt which can be advanced to feed the lowest pad out of a second hopper and into pad delivery mechanism of the machine.

Briefly, this invention provides a machine which includes a first hopper in which a first stack of pads can be mounted. A first belt conveyor feeds pads from the bottom of the first stack and advances the pads up a first incline and then down a second incline from which the pads are delivered into the upper portion of a second hopper. A second belt conveyor feeds the pads one at a time from the bottom of the second hopper to a nip station. When a pad is required, it is drawn from the second conveyor belt by nip rolls which engage opposite sides of a leading pad. A short second stack of pads is maintained in the second hopper and when the short stack is reduced as the pads are fed from the second hopper, the first conveyor is operated to replenish the second stack.

The above and other objects and features of the invention will be apparent to those skilled in the art to which this invention pertains from the following detailed description and the drawings in which.

In the following detailed description and the drawings, like reference characters indicate like parts.

Figure 1:
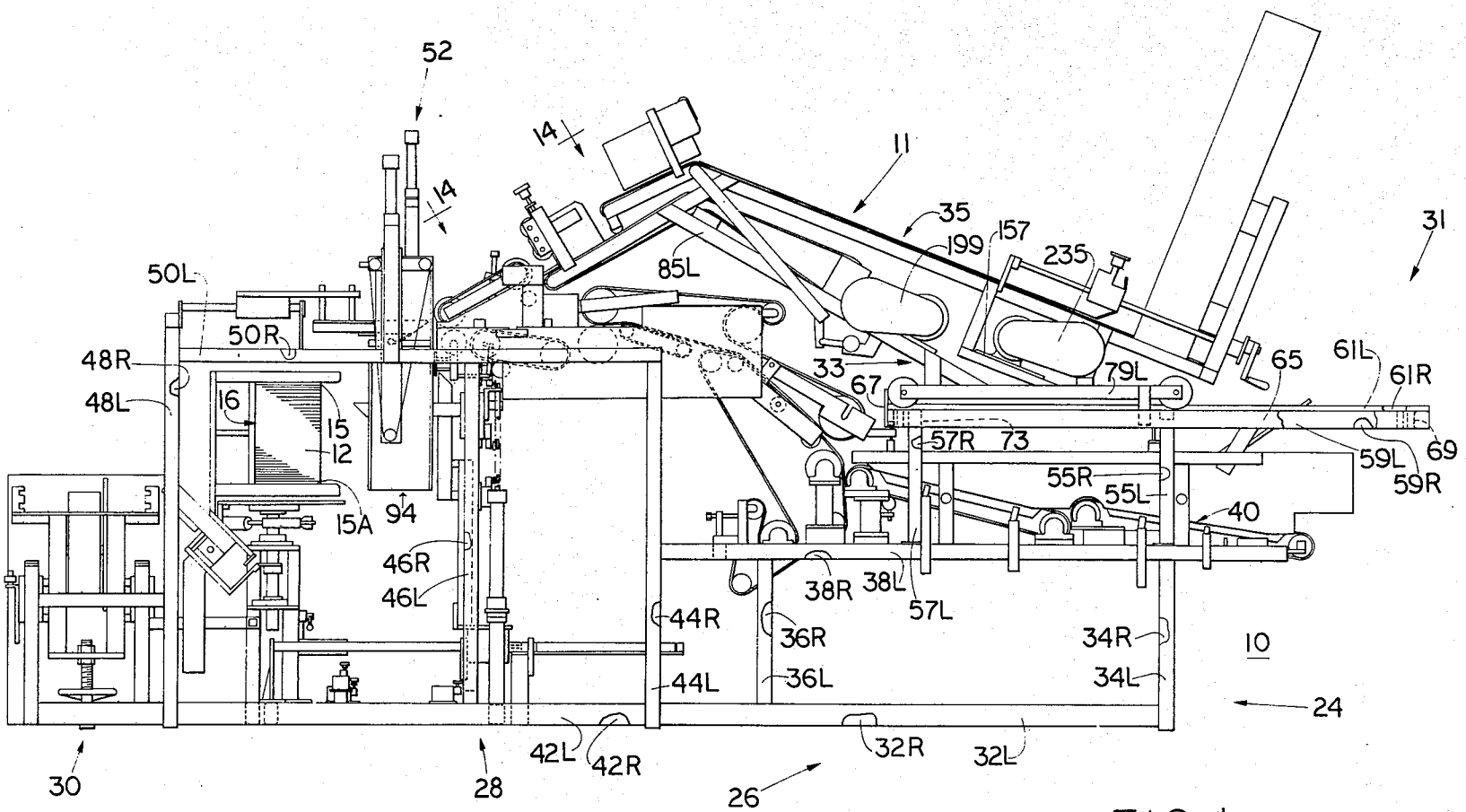
FIG. 1 is a view in side elevation of a carton bundling machine on which is mounted a pad delivering device constructed in accordance with an embodiment of this invention.

In FIG. 1 is shown a pad inserter machine 11 which is constructed in accordance with an embodiment of this invention. The pad inserter machine 11 is an independent machine that is generally used in combination with a bundle accumulator machine 10. Details of construction of the bundle accumulator machine are described in co-pending application Ser. No. 476,578, filed June 5, 1974 for STACKING AND BUNDLING MACHINE. A partial description of the bundle accumulator machine 10 will be hereinafter included for a full understanding of the interface between the pad inserter machine 11 and the bundle accumulator machine 10.

Figure 1A:
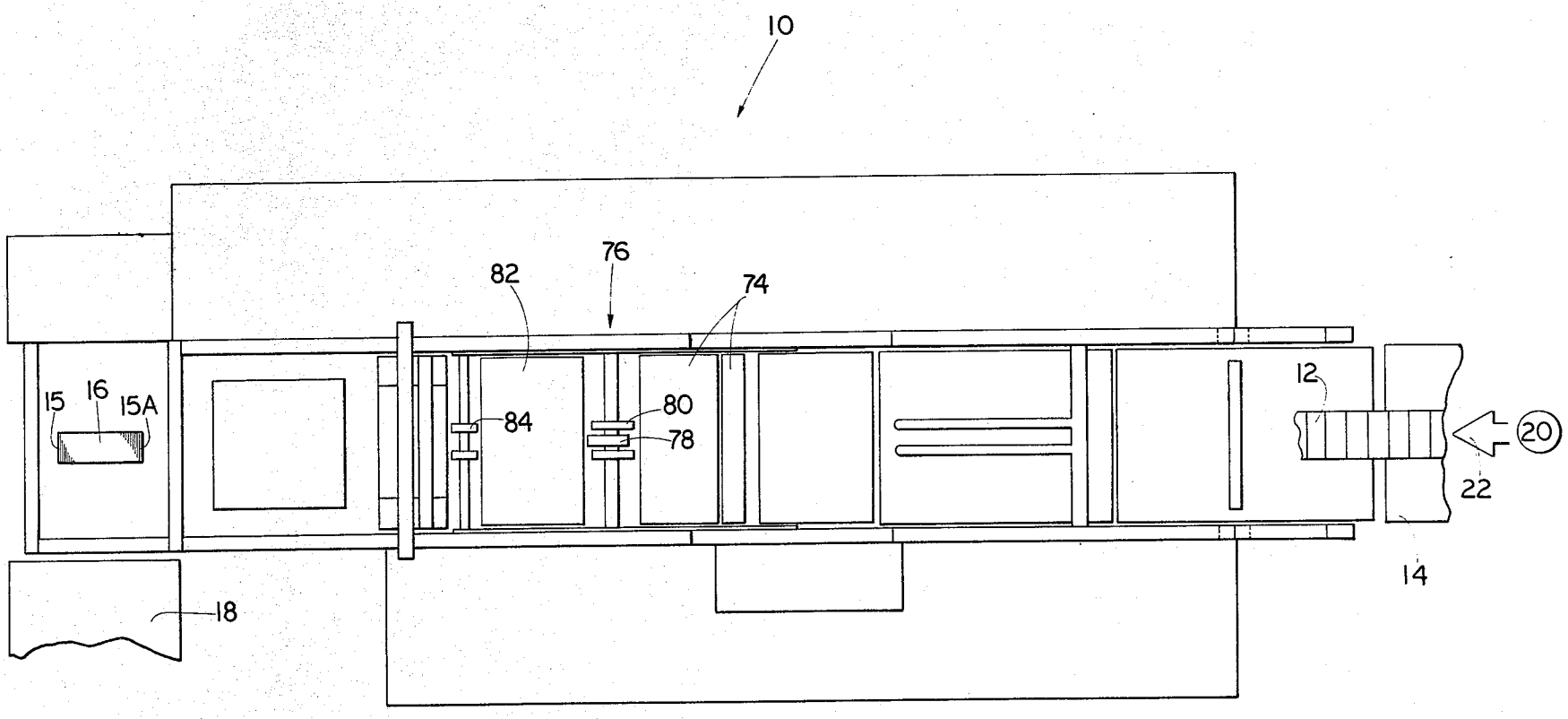
FIG. 1A is a schematic plan view of the carton bundling machine shown in FIG. 1.

The bundle accumulator machine 10, as shown in FIGS. 1 and 1A, accepts a procession of flattened cartons 12 (FIG. 1A), overlapped in a shingled fashion, from an apron conveyor 14 located to the right of the bundle accumulator machine 10. This is hereinafter termed the "feed end" of the bundle accumulator machine 10. The apron conveyor 14 is the terminus of a sealer/gluer machine (not shown in detail) which provides the shingled procession of cartons 12 for packaging. The bundle accumulator machine 10 delivers at timed intervals and in proper orientation, a stack of cartons 16 to a cassette receiver 18 of a bundle overwrap machine (not shown in detail) that is generally located to the left side terminus of the bundle accumulator machine 10. This is hereinafter termed the "output end" of the bundle accumulator machine 10.

The purpose of the pad inserter machine 11 (FIG. 1) is to place a corrugated piece of cardboard, hereinafter called a pad 15 (FIG. 1A), over each end of a stack of cartons 16 for protection thereof so that the completed stack 16, as shown in FIG. 1, includes a first pad 15 at one end thereof, a second pad 15A at the opposite end thereof, and a plurality of flattened cartons 12 between the pads 15 and 15A. The pad inserter machine 11 can be manually loaded in an intermittent fashion. The pad inserter machine 11 overcomes temporary loading delays to provide a continuous supply of pads 15 to the bundle accumulator machine 10. The same orientation terms apply to the pad inserter machine 11 as to the bundle accumulator machine 10. Orientation terms to be used hereinafter are now defined. Referring to FIG. 1A, an observer 20 views the bundle accumulator machine 10 and the pad inserter machine 11 from the feed end and looks toward the output end of the machine as is indicated by an arrow 22. The right side of the bundle accumulator machine 10 and the pad inserter machine 11 is the right hand side of the observer 20. The left side of the bundle accumulator machine 10 and the pad inserter machine 11 is the left hand side of the observer 20. The procession of cartons 12 travel along a line from the feed end to the output end of the bundle accumulator machine 10. The longitudinal direction is parallel to this line of carton travel. The lateral direction is perpendicular to the longitudinal direction and disposed in a horizontal attitude with respect thereto.

Major assemblies of the bundle accumulator machine 10 and the pad inserter machine 11 are held in spaced relationship with each other by means of a basic framework 24, as indicated in FIG. 1. The basic framework 24 is comprised of three major subassemblies; a feed frame assembly 26, an elevator frame assembly 28, and a push-off frame assembly 30. A pad inserter subframe assembly 31 is mounted on top of the feed frame assembly 26. A rolling frame assembly 33 of the pad inserter machine 11 moves atop the pad inserter subframe assembly 31. An incline conveyor frame assembly 35 is slidably mounted atop the rolling frame assembly 33.

The feed frame assembly 26 is comprised of a pair of bottom feed stringers 32L and 32R, which provide base support for a pair of input feed posts 34L and 34R and a pair of output feed posts 36L and 36R which in turn provide vertical spaced relationship for a pair of top feed stringers 38L and 38R. The pair of top feed stringers 38L and 38R provide mechanical support for the subassemblies of a feed conveyor assembly 40 that is described in the aforementioned co-pending application Ser. No. 476,578. Also supported upon the pair of top feed stringers 38L and 38R is the pad inserter subframe assembly 31 to be hereinafter described. Appropriate cross members (not shown in FIG. 1) provide fixed spaced relationship between the right and left hand sides of the feed frame assembly 26.

The elevator frame assembly 28 is comprised of a pair of bottom elevator stringers 42L and 42R, which provide base support for a pair of input elevator posts 44L and 44R, a pair of elevator posts 46L and 46R, and a pair of output elevator posts 48L and 48R. These posts in turn provide mechanical support and spaced elevation for a pair of top elevator stringers 50L and 50R. The pair of top elevator stringers 50L and 50R provide an upper framework support for a stacking assembly 52. Appropriate cross members (not shown in FIG. 1) provide spaced lateral relationship between the right and left hand sides of the elevator frame assembly 28. Specific cross members will be discussed in detail hereinafter.

The three major frame assemblies 26, 28, and 30 are fixedly attached to each other to form the unitized basic framework 24.

Figure 4:
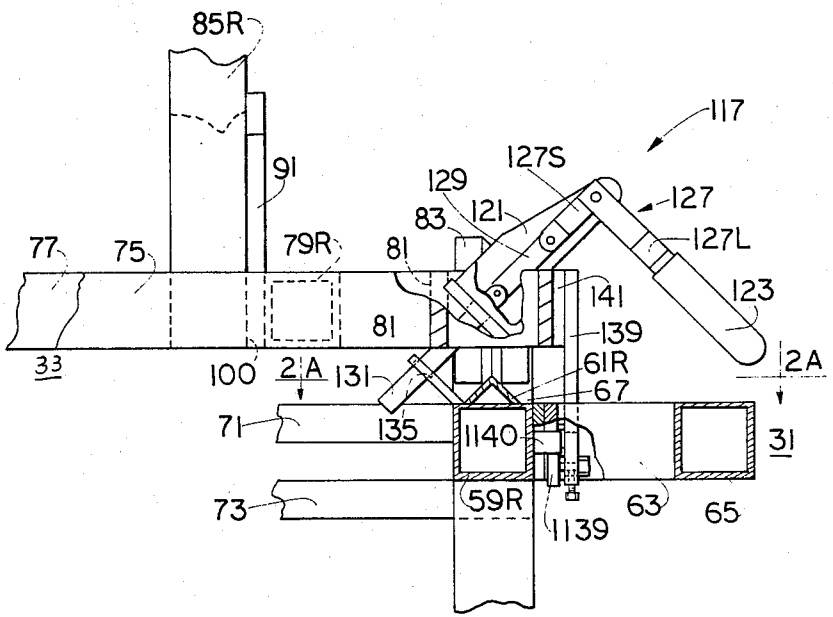
FIG. 4 is a view in section taken on an enlarged scale on the line 4—4 in FIG. 2, the stop being shown in engaged position.
Figure 3:
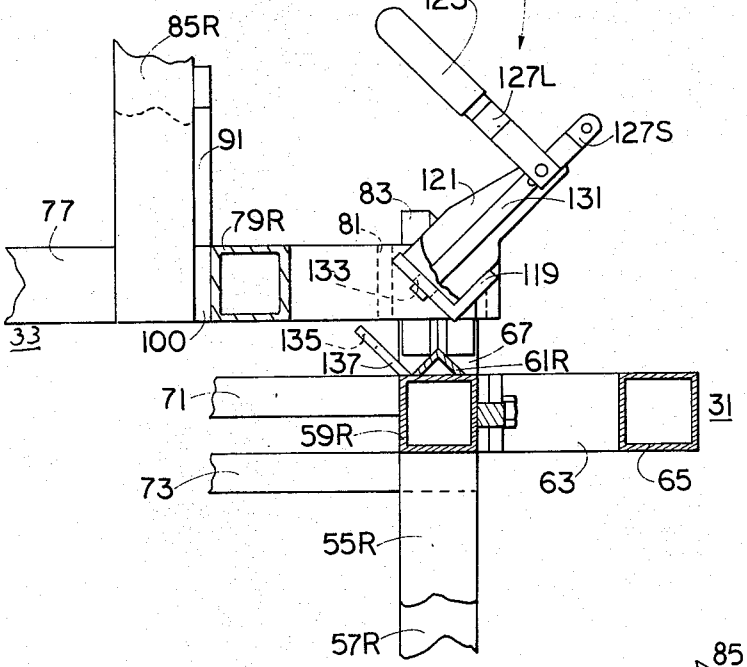
FIG. 3 is a view in section taken on an enlarged scale on the line 3—3 in FIG. 2 showing a stop in released position.
Figure 2:
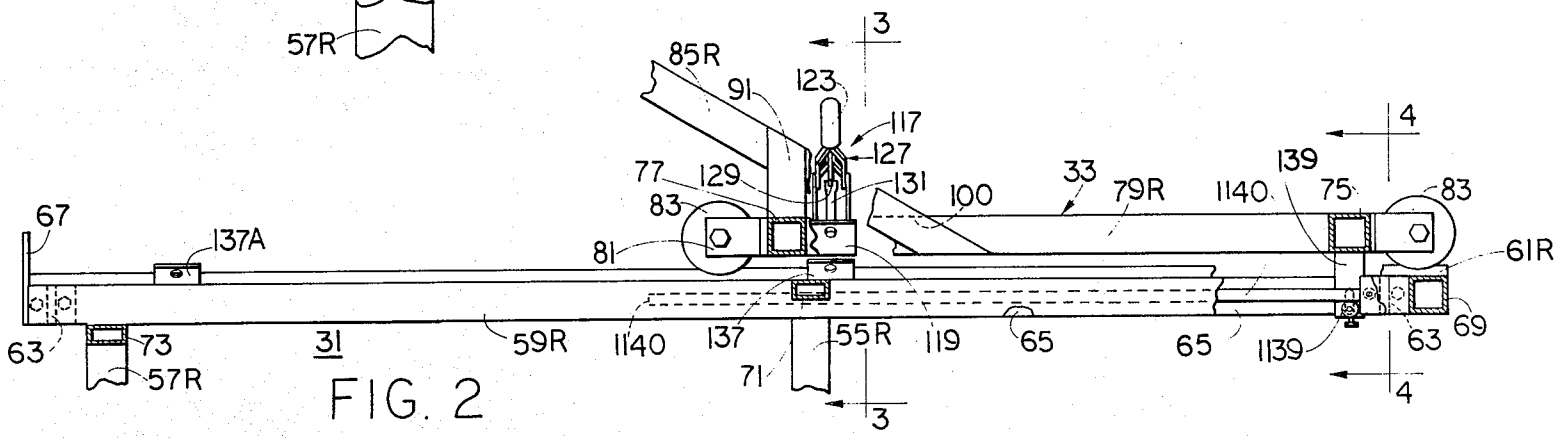
FIG. 2 is a fragmentary view in side elevation partly broken away and in section showing a frame portion of the bundling machine and a wheeled frame portion of the pad delivering device.

The pad inserter subframe assembly 31, shown in FIGS. 1, 2, 3, and 4, is comprised of a pair of input risers 55L (FIG. 1) and 55R (FIGS. 1, 2, and 3), and a pair of output risers 57L (FIG. 1) and 57R that are fixedly mounted on top of the pair of top feed stringers 38L and 38R. A pair of horizontal stringers 59L and 59R (FIGS. 1 and 2) are longitudinally and fixedly mounted across the top of the pair of input risers 55L and 55R and the pair of output risers 57L and 57R. Fixedly attached to the top of the pair of horizontal stringers 59L and 59R is a pair of guide rails 61L and 61R. The pair of guide rails 61L and 61R are triangular in cross section and are each formed of an inverted angle iron with its open side turned downwards, as the switch rail 61R is shown in FIGS. 3 and 4. A set of four spacer brackets 63 (FIGS. 2 and 3) are fixedly attached to the outside surfaces of and adjacent end portions of the pair of horizontal stringers 59L and 59R and extend laterally outward a short distance. Fixedly attached to the ends of the set of four spacer brackets 63 and in parallel alignment with the pair of horizontal stringers 59L and 59R is a pair of guard stringers 65. The pair of guard stringers 65 prevent lateral movement of personnel into the rolling frame assembly 33. The output end of the pair of horizontal stringers 59L and 59R (FIGS. 1 and 2) are fixedly fitted with a pair of end stops 67 to prevent the rolling frame assembly 33 of the pad inserter machine 11 from moving off the output end of the pair of guide rails 61L and 61R. Referring to FIG. 2, the right and left sides of the pad inserter subframe assembly 31 are held in lateral spaced relationship by a subframe input cross member 69, a subframe middle cross member 71 and a subframe output cross member 73, all laterally and fixedly attached between the pair of horizontal stringers 59L and 59R.

Figures 2A, 5:
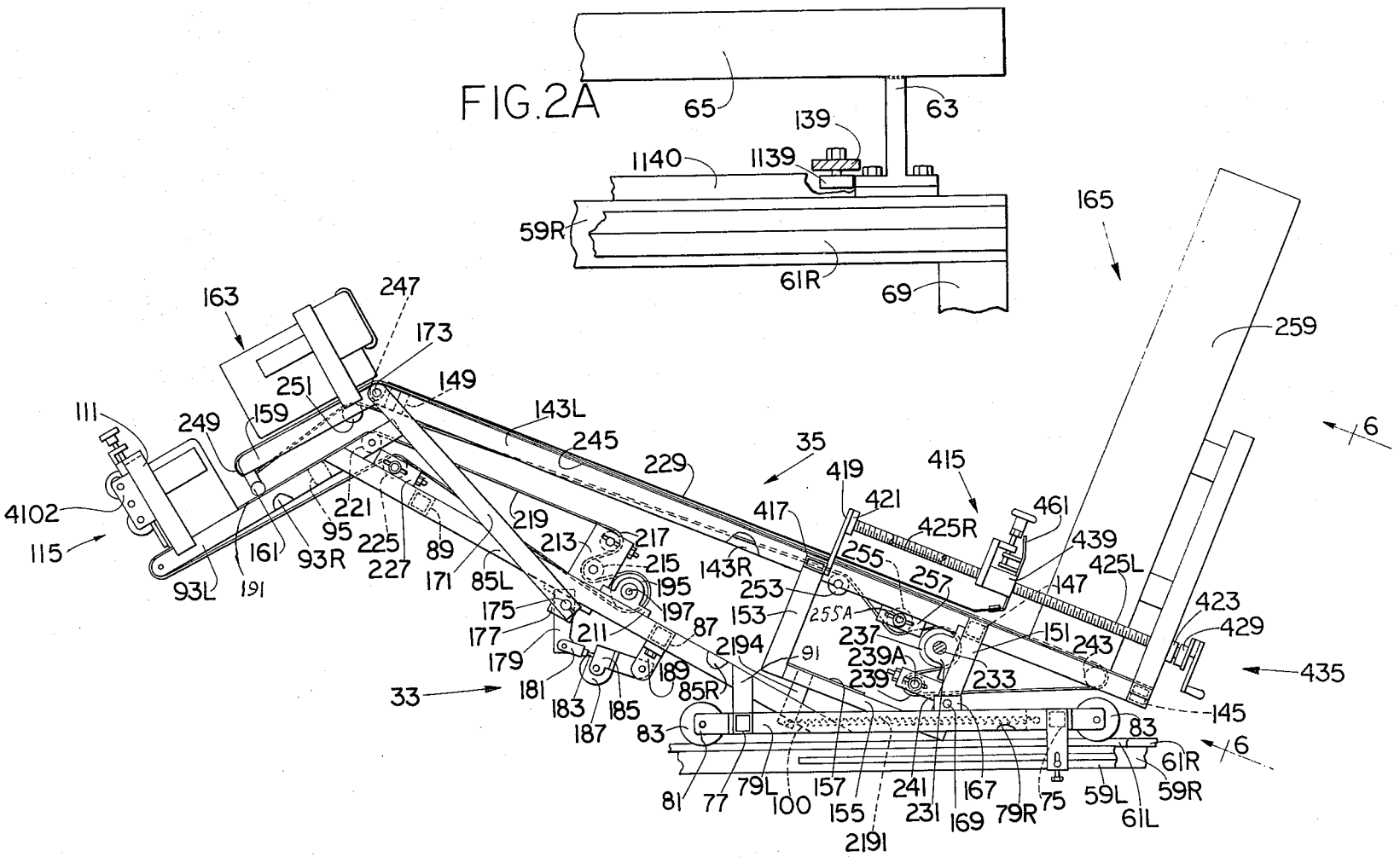
FIG. 2A is a fragmentary view in section taken on the line 2A—2A in FIG. 4.
FIG. 5 is a view in side elevation of the pad delivering device partly broken away to reveal structural details.

The rolling frame assembly 33 (FIGS. 3, 4 and 5) of the pad inserter machine 11 comprises an input cross tube 75 and an output cross tube 77 that are held in longitudinal placement by a pair of main runners 79L (FIG. 1) and 79R (FIG. 2). The pair of main runners 79L and 79R are in narrow lateral alignment with each other and cooperate to support the structure of the incline conveyor frame assembly 35 (FIGS. 1 and 5). A set of four U-shaped wheel mounts 81 are fixedly mounted to the outboard surfaces of and at the ends of the input cross tube 75 and the output cross tube 77. The set of four U-shaped wheel mounts 81 rotatably hold a set of four V-groove wheels 83. The set of four V-groove wheels 83 cooperate with the pair of guide rails 61L and 61R to provide mobility to the pad inserter machine 11 in the longitudinal direction only. A pair of incline tubes 85L and 85R are fixedly attached by means of a pair of spacers 100 (FIGS. 3 and 4) to the inboard surfaces of the pair of main runners 79L and 79R approximate to the output cross tube 77 and at an angle of 30° with respect to the horizontal. The incline tube 85L is fixedly held in spaced lateral relationship with the incline tube 85R by means of a bottom spreader 87, and a top spreader 89 (FIG. 5). A pair of flat plates 91 are fixedly and vertically mounted on top of the output cross tube 77 and fixedly attached to the outboard sides of the pair of incline tubes 85L and 85R to reinforce its cantilever attachment to the pair of main runners 79L and 79R (see FIGS. 3 and 4).

Figure 14:
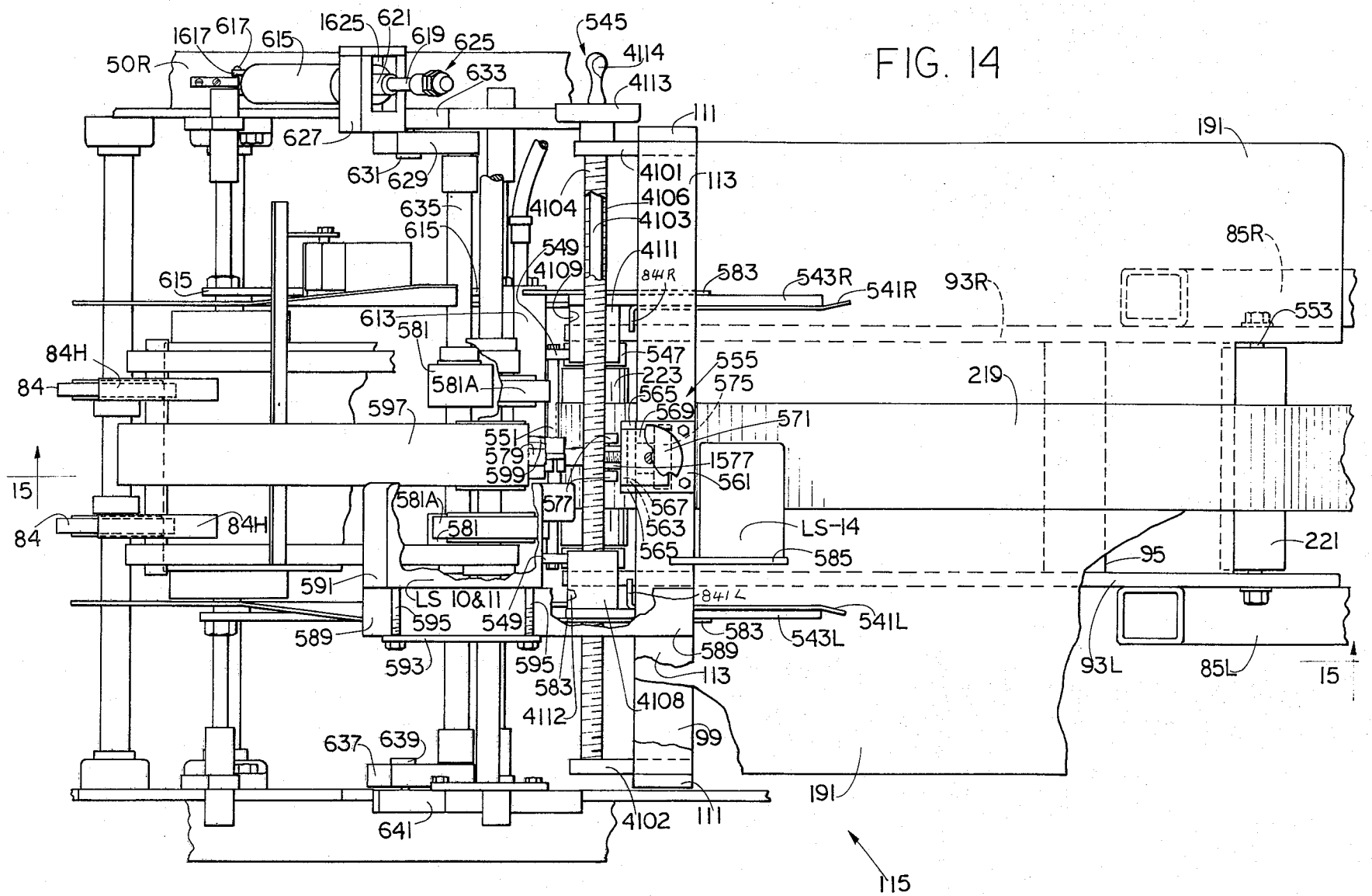
FIG. 14 is a view on an enlarged scale looking in the direction of arrows 14—14 in FIG. 1, parts being broken away to reveal structural details.
Figure 15:
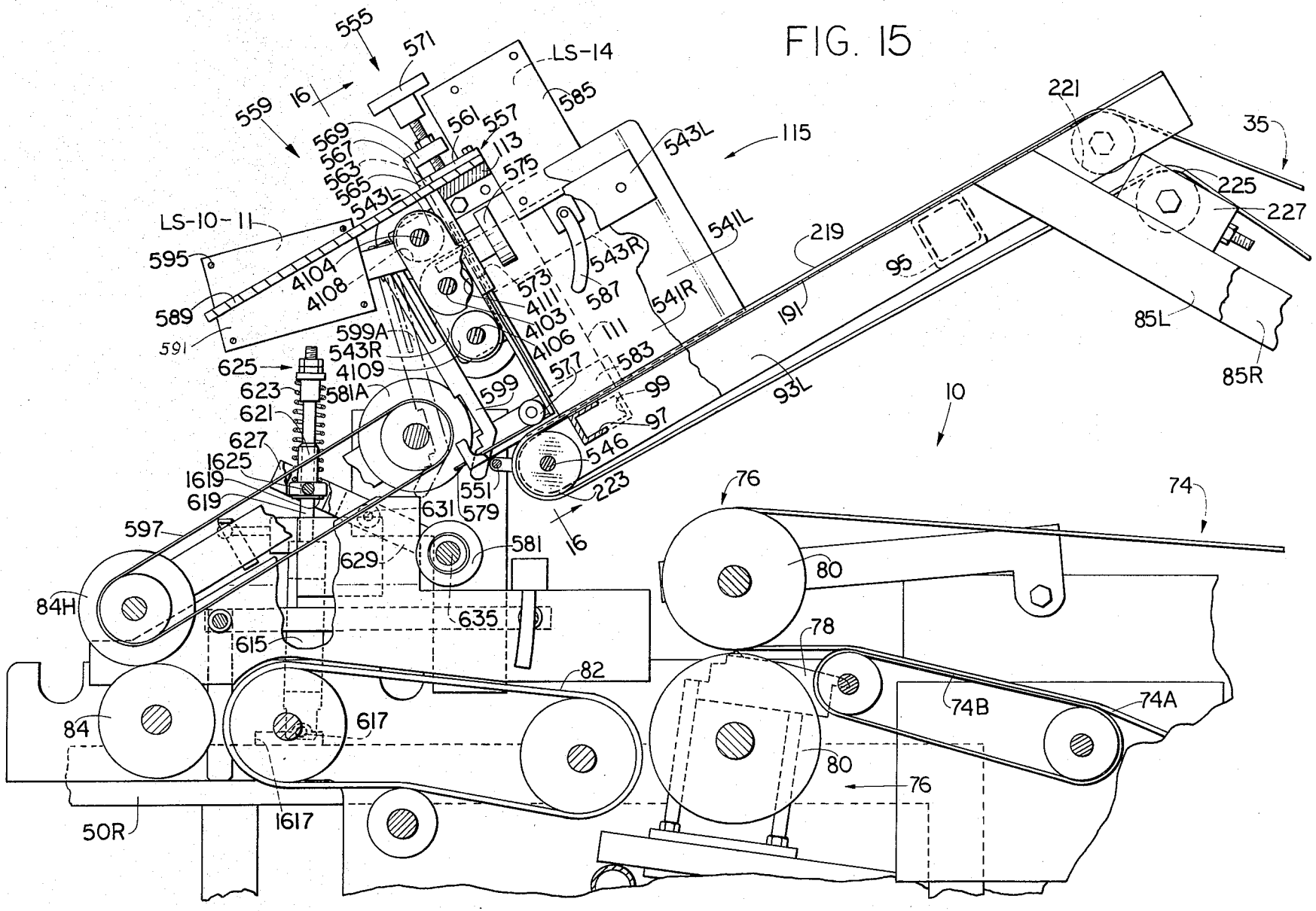
FIG. 15 is a view in section taken generally on the line 15—15 in FIG. 14.

A pair of nip conveyor booms 93L and 93R (see FIG. 5) are fixedly attached to the inboard surfaces of, and at the upper ends of the pair of incline tubes 85L and 85R. The pair of nip conveyor booms 93L and 93R open an angle of 120° with respect to the pair of incline tubes 85L and 85R, or 30° with respect to the horizontal. The pair of nip conveyor booms 93L and 93R are fixedly held in lateral spaced relationship by an upper spreader 95 and a lower spreader 97 (FIG. 15). Both the upper spreader 95 and the lower spreader 97 are fixedly attached to the inboard surfaces of the pair of nip conveyor booms 93L and 93R. A pair of frame outriggers 99 (FIG. 14) are fixedly attached to the outside surfaces of the pair of nip conveyor booms 93L and 93R and extend laterally outward and in alignment with the lower spreader 97. The lower spreader 97 and the pair of frame outriggers are located near the ends of the pair of nip conveyor booms 93L and 93R as can be seen in FIGS. 5 and 14. A pair of upright members 111 are fixedly attached to the outer ends of the pair of frame outriggers 99, and extend upward and perpendicular to the orientation of the pair of nip conveyor booms 93L and 93R. The upper ends of the pair of upright members 111 are held in fixed lateral rigidity by a spacer bar 113 (FIG. 15) to form a rectangular framework in which to mount a front hopper assembly 115, as will be described in detail hereinafter.

The rolling frame assembly 33 can be placed in one of two positions atop the pad inserter subframe assembly 31. FIG. 1 shows the pad inserter machine 11 in the feed position, that is, the rolling frame assembly 33 resting at the output end of the pad inserter subframe assembly 31. The second position, the remote storage position, is illustrated in FIG. 2. The rolling frame assembly 33 is secured in either position by means of a lock assembly 117 as shown in FIGS. 2, 3 and 4. The lock assembly 117 comprises a lock mount 119 that is fixedly attached in cantilever manner to the side of the output cross tube 77 on the right side of the rolling frame assembly 33. A lock yoke 121 is fixedly attached to the lock mount 119. The lock assembly 117 also comprises a lock handle 123 that is fixedly attached to a pivot yoke 127 that incorporates a short yoke portion 127S and a long yoke portion 127L disposed perpendicular to each other. The pivot yoke 127 is pivotally mounted at the upper end of the lock yoke 121. A pall link 129 (FIG. 4) is pivotally attached within the end of the short yoke portion 127S and also pivotally attached within an end of a pall 131. The pall 131 passes through a hole 133 (FIG. 3) in the base of the lock mount 119 that holds the pall 131 in position for alignment with a hole 135 incorporated in one of a pair of locking ears 137 and 137A (FIG. 2). The locking ears 137 and 137A are fixedly attached to the right hand guide rail 61R. The locking ear 137A cooperates with the pall 131 when the rolling frame assembly 33 is in feed position of the pad inserter machine 11, and the other locking ear 137 cooperates with the pall 131 when the rolling frame assembly 33 is in the remote storage position of the pad inserter machine 11 as shown in FIG. 2 and previously described. FIGS. 2 and 3 show the lock handle 123 in an up position at which the pall 131 is retracted from the hole 135 in the locking ear 137. FIG. 4 shows the locking handle 123 rotated down 180° to move the pall 131 downwardly and into the hole 135 of the locking ear 137 to restrain further movement of the rolling frame assembly 33. The rolling frame assembly 33 is restrained from running off the feed end of the pair of guide rails 61L and 61R by means of a pair of stop support arms 139, one of which is shown in FIGS. 2 and 4. The pair of stop support arms 139 are fixedly attached to a pair of stop anchors 141 that are rigidly mounted to the ends of the input cross tube 75. Each of the pair of stop support arms 139 extends downwardly from the cross tube 75. As shown in FIG. 4, a roller 1139 is rotatably mounted on each stop support arm 139. Each roller 1139 underlies and runs on a rail 1140. The rails 1140 are attached to outer faces of the horizontal stringers 59L and 59R in the manner shown in FIG. 4. Each roller 1139 can engage one of the set of four spacer brackets 63 at the feed end of the pad inserter subframe assembly 31.

The incline conveyor frame assembly 35, shown in FIG. 5, is comprised of a pair of long slide rails 143L and 143R that are held in lateral spaced relationship by a lower rail spreader 145, a motor hander rail spreader 147, and an upper rail spreader 149 located near the upper ends of the long slide rails 143L and 143R. The incline conveyor assembly 35 also incorporates a pair of infeed motor hanger posts 151 that are fixedly attached to the pair of long slide rails 143L and 143R adjacent to the motor hanger rail spreader 147. A pair of output motor hanger posts 153 are fixedly attached to the pair of long slide rails 143L and 143R to cooperate with the pair of infeed motor hanger posts 151, to form a mounting structure for a pair of motor mount rails 155 rigidly fixed between the lower ends thereof. The pair of motor mount rails 155 are held in fixed lateral relationship by means of a motor mount plate 157 fixedly mounted to the top thereof. A pair of short booms 159 are pivotally attached to the upper ends of the pair of long slide rails 143L and 143R. The pair of short booms 159 are held in lateral spaced relationship by appropriate cross members to be hereinafter discussed. The free ends of the pair of short booms 159 are fitted with a pair of small rollers 161, to facilitate the movement of the incline conveyor frame assembly 35 atop the rolling frame assembly 33. The pair of short booms 159 is fitted with a pad chute assembly 163 that also will be described in detail hereinafter. The lower end of the incline conveyor frame assembly is equipped with a main hopper assembly 165 to be described hereinafter.

Figure 18:
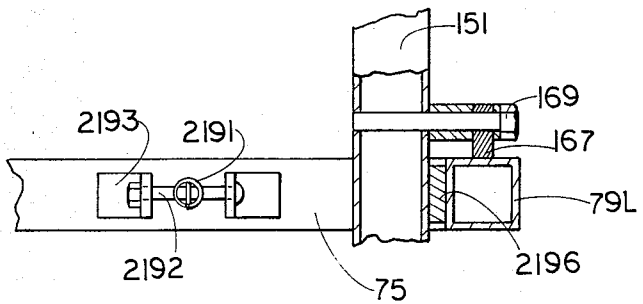
FIG. 18 is a fragmentary view in upright section showing details of a pivot shoe of the pad delivery device.

The incline conveyor frame assembly 35 rests upon and moves with respect to the rolling frame assembly 33. A pair of pivot shoes 167 are pivotally attached to the pair of infeed motor hanger posts 151 by means of a pair of shoe spindles 169 (see FIGS. 5 and 18). The pair of pivot shoes 167 permits the incline conveyor frame assembly 35 to rest upon and the pivot shoes 167 can slidably move longitudinally upon the top of the pair of main runners 79L and 79R of the rolling frame assembly 33. Bearing pads 2196 mounted on inner faces of the main runners 79L and 79R, one of which is shown in FIG. 18, guide the hanger posts 151 as the pivot shoes move along the runners 79L and 79R. The upper end of the incline conveyor frame assembly 35 (FIG. 5) is linked to the rolling frame assembly 33 by means of a pair of main adjustment crank arms 171. The upper ends of the pair of main adjustment crank arms 171 are pivotally attached to the intersection of the pair of short booms 159 and the pair of long slide rails 143L and 143R by means of a pair of bolts 173. The lower ends of the pair of main adjustment crank arms 171 are fixedly attached to the ends of a pivot shaft 175 that spans the width of the pair of incline tubes 85L and 85R. The pivot shaft 175 is pivotally held by a pair of pivot shaft mounts 177 that are fixedly attached to the underside surfaces of the pair of incline tubes 85L and 85R. A jack arm 179 is fixedly attached at the center of the pivot shaft 175 for rotation thereof. The lower end of the jack arm 179 is pivotally fitted with a jack clevis 181 into which is fixedly attached a jack rod 183 of a jack 185. The jack 185 is adjusted manually by means of a wheel and handle combination 187 that is located on the right side of the jack 185. A mounting lug of the jack 185 is pivotally mounted in a yoke type jack anchor 189 that is fixedly bolted to the underside of the bottom spreader 87 of the rolling frame assembly 33. As the wheel and handle combination 187 is turned, a worm gear arrangement (not shown in detail) within the jack 185 extends or retracts the jack rod 183 to rotate the jack arm 179, the pivot shaft 175 and the pair of main adjusting crank arms 171 in unison. When the jack rod 183 is expanded, the intersection between the pair of short booms 159 and the pair of long slide rails 143L and 143R is raised and the entire incline conveyor frame assembly 35 is moved toward the feed end of the rolling frame assembly 33. Therefore, the pair of small rollers 161 of the short booms 159 roll up a base plate 191 to increase the distance between the front hopper assembly 115 and the end of the incline conveyor frame assembly 35. This permits adjusting of the pad inserter machine 11 to permit use of pads 15 of various sizes. A tension spring 2191 (FIGS. 5 and 18) urges the incline conveyor frame assembly 35 toward the input end of the rolling frame assembly 33. The tension spring 2191 extends between a pin 2192 (FIG. 18) carried by brackets 2193 mounted on the cross tube 75 and a spring mount carried by bracket arms 2194 (FIG. 5) supported on the underside of the motor mount plate 157.

Also referring to FIG. 5, the rolling frame assembly 33 incorporates a pad nip conveyor 219. The pad nip conveyor 219 runs on demand, as will be described hereinafter, to deliver single pads 15 to the bundle accumulator machine 10. The pad nip conveyor 219 runs on a drive drum 195 rigidly held on a nip conveyor drive shaft 197 to which power is delivered by a nip conveyor motor and belt assembly 199 shown in FIG. 1. The nip conveyor drive shaft 197 (FIG. 5) is rotatably held in a pair of bearing blocks 211 (only one of which is shown) fixedly attached to the top surfaces of the pair of incline tubes 85L and 85R of the rolling frame assembly 33. A pair of pulley mounts 213 is fixedly attached to the inside surfaces of the pair of incline tubes 85L and 85R approximate to the pair of bearing blocks 211. The pulley mounts 213 support a lower idle pulley 215 and a top takeup pulley 217. The takeup pulley 217 permits tension adjustment of the nip conveyor belt 219. The nip conveyor belt 219 then passes upward to a top idle pulley 221 rotatably mounted between the top ends of the pair of nip conveyor booms 93L and 93R. The nip conveyor belt then passes downwardly, sliding over the base plate 191 (FIG. 15), to an output idler 223 rotatably mounted between the lower ends of the pair of nip conveyor booms 93L and 93R. The belt 219 wraps around the pulley 223 to pass upwardly and over a middle idle pulley 225 rotatably mounted in a pair of pulley mounts 227 that are fixedly attached to the inside surfaces of the pair of incline tubes 85L and 85R. The nip conveyor belt 219 continues approximately parallel to the pair of incline tubes 85L and 85R to pass counterclockwise around and over the drive drum 195 (FIG. 5). The nip conveyor belt 219 also passes in a clockwise manner around the lower idle pulley 215. The belt loop is completed as the nip conveyor belt 219 passes counterclockwise up and around the top takeup pulley 217.

The incline conveyor frame assembly 35 incorporates an incline conveyor belt 229 supported upon a series of pulleys to be herein described. The incline conveyor belt 229 carries pads 15 from the main hopper assembly 165 up and through the pad chute assembly 163 and runs the pads 15 into the front hopper assembly 115, until the front hopper assembly 115 is full. The incline conveyor belt 229 operates when a lack of pads 15 is indicated in the front hopper assembly 115. A pair of bearings 231 are fixedly attached to the output side of the pair of infeed motor hanger posts 151, to rotatably hold an incline conveyor drive shaft 233. Drive power is delivered to the incline conveyor drive shaft 233 by an incline conveyor motor and belt assembly 234 shown in FIG. 1. As can be seen in FIG. 1, the incline conveyor motor is fixedly attached to the motor mount plate 157. The incline conveyor drive shaft 233 (FIG. 5) is fixedly fitted with a conveyor drive drum 237. The incline conveyor belt 229 passes over the conveyor drive drum 237 and passes downward and around a bottom takeup pulley 239 that is rotatably held on a shaft 239A that is adjustably held by a pair of pulley blocks 241. The pair of pulley blocks 241 are fixedly attached to the inside surface of the pair of infeed motor hanger posts 151.

The incline conveyor belt 229 passes horizontally toward the infeed end of the pad inserter machine 11, and wraps counterclockwise around an input pulley 243. The input pulley 243 is rotatably held between the lower ends of the pair of long slide rails 143L and 143R. The incline conveyor belt 229 then slides up and over a brace plate 245 that is fixedly mounted on top of the pair of long slide rails 143L and 143R. At the top of the incline conveyor frame assembly 35 the incline conveyor belt 229 passes counterclockwise over a top idler 247 (FIG. 13), then downwardly along the pair of shsort booms 159 to an end idler 249. The incline conveyor belt 229 wraps around the end idler 249 and returns toward the convey drive drum 237 by passing over a bottom idler 251 that is rotatably mounted between the upper ends of the pair of short booms 159. The incline conveyor belt 229 then proceeds down the incline conveyor frame assembly 35 to a support idler 253 (FIG. 5), that is rotatably held between the pair of long slide rails 143L and 143R approximate to the pair of output motor hanger posts 153. The incline conveyor belt passes under an adjustable idler 255 before returning to the conveyor drive drum 237. The adjustable idler 255 is rotatably held on a shaft 255A that is adjustably mounted in a pair of slotted mounts 257. The slotted mounts 257 are fixedly attached to the inside surface of the pair of long slide rails 143L and 143R and positioned between the pair of infeed motor hanger posts 151 and the pair of output motor hanger posts 153.

Figures 7, 8:
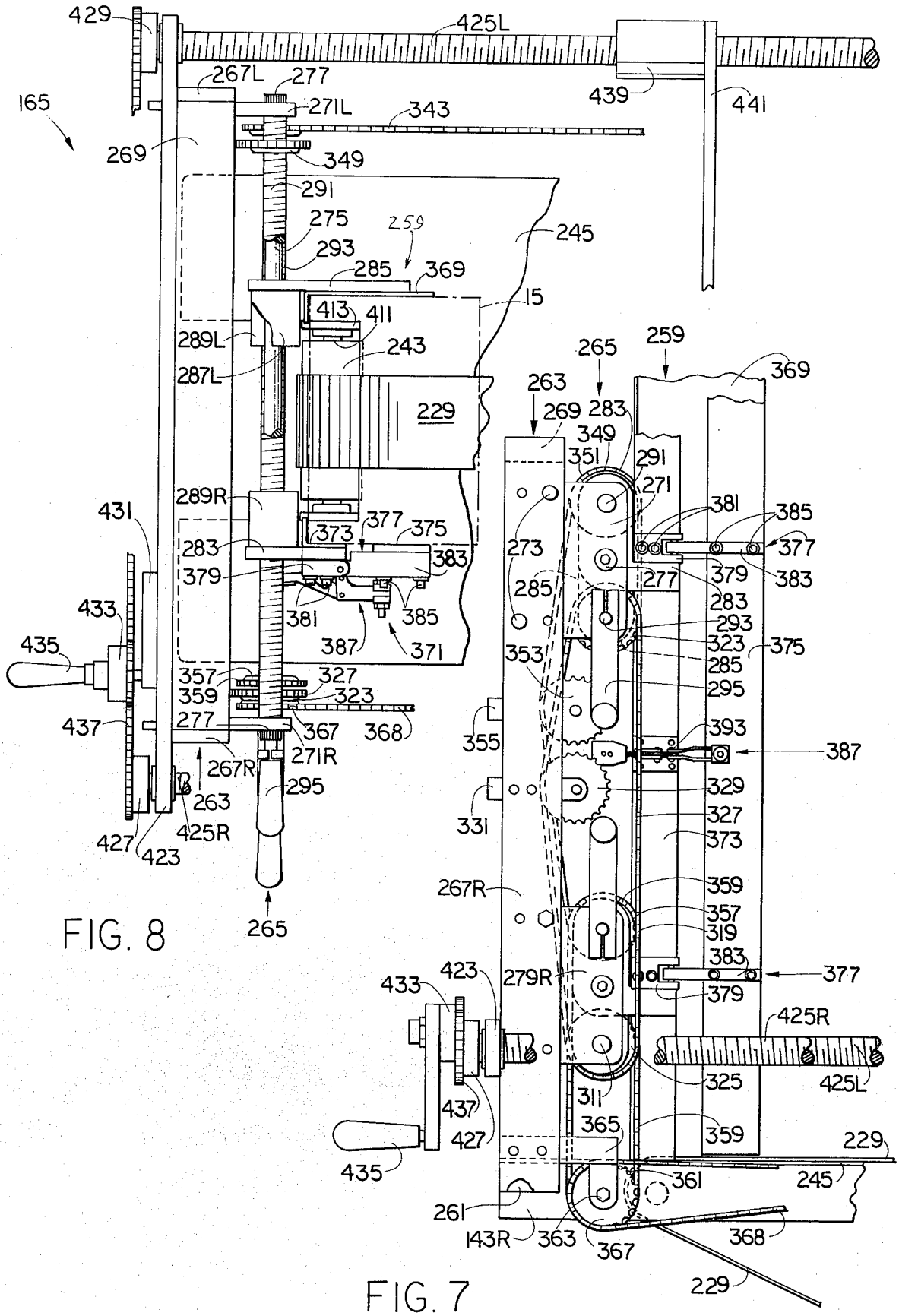
FIG. 7 is a fragmentary view in side elevation looking in the direction of the arrows 7—7 in FIG. 6.
FIG. 8 is a fragmentary plan view looking in the direction of the arrows 8—8 in FIG. 6, pads being shown in dot-dash lines.

The main hopper assembly 165 is fixedly mounted on top of the infeed end of the incline conveyor frame assembly 35 as shown in FIG. 5 and includes a main hopper 259, which is manually and therefore intermittently loaded with pads 15 as indicated in FIG. 8. A stack of pads is maintained in the main hopper 259 on top of the belt 229, and the pads are fed from the main hopper 259 on the incline conveyor belt 229 to provide a continuously available supply of pads 15 to the front hopper assembly 115.

Figure 6:
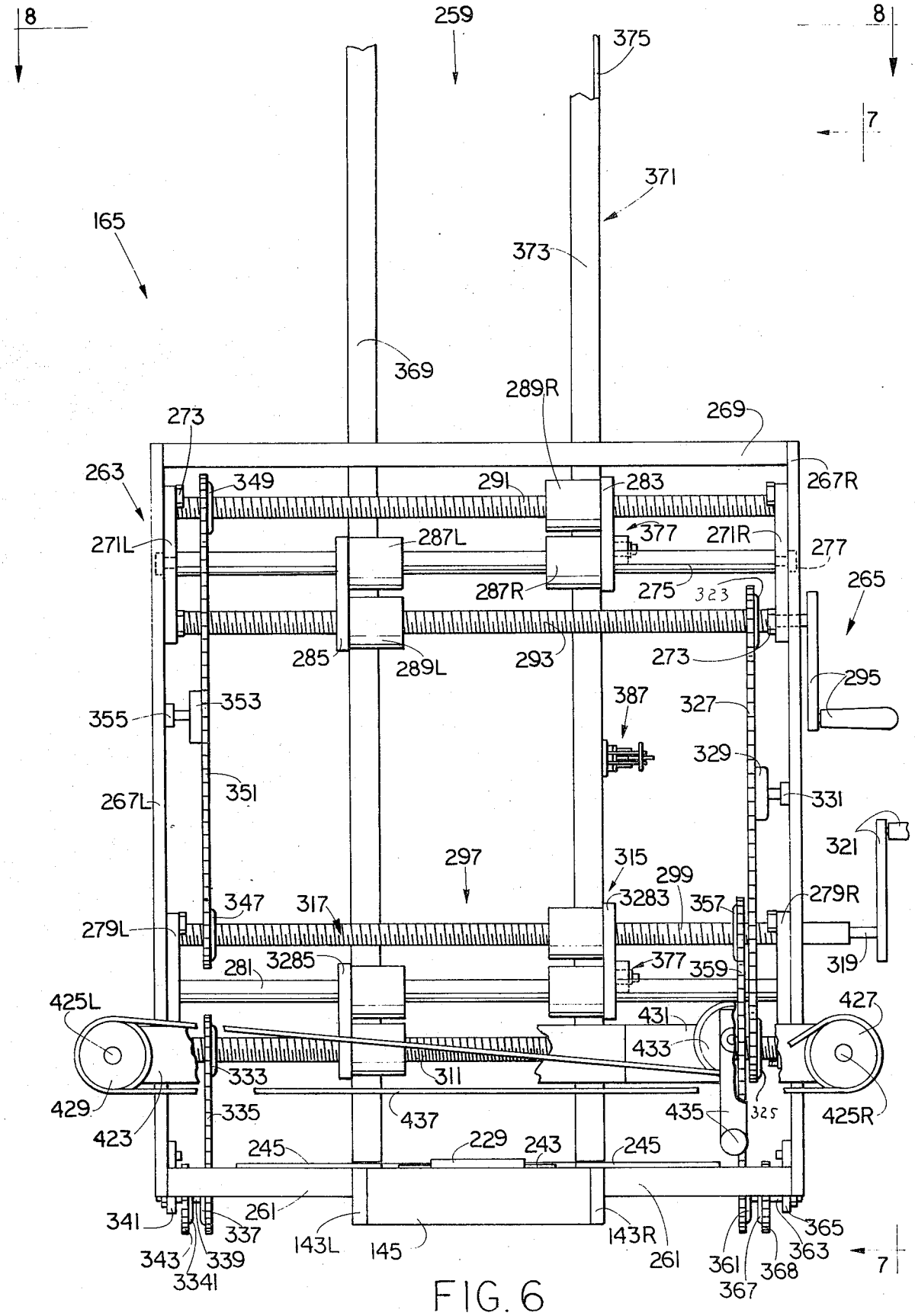
FIG. 6 is a view in end elevation taken in the direction of the arrows 6—6 in FIG. 5.

The main hopper assembly 165 is shown in detail in FIGS. 6, 7 and 8. The main hopper assembly 165 is comprised of a main hopper frame 263 (FIG. 8), a width adjusting assembly 265 and the main hopper 259 (FIGS. 6 and 7).

The main hopper frame 263 (FIG. 8) is comprised of a pair of base outriggers 261 (FIGS. 6 and 7) rigidly affixed to the outside surfaces of the pair of long slide rails 143L and 143R and extending laterally therefrom. A pair of upright members 267L and 267R are rigidly affixed to the ends of the pair of base outriggers 261. A main hopper tie bar 269 is rigidly affixed between the top ends of the pair of upright members 267L and 267R and provides lateral spaced relationship therebetween. A pair of top screw mounting plates 271L and 271R is fixedly attached to the inside upper surfaces of the pair of upright members 267L and 267R by a set of four bolts 273. The set of four bolts 273 are threadably mounted in the pair of upright members 267L and 267R. A top slide rod 275 is fixedly attached between the pair of top screw mounting plates 271 by meanas of a pair of bolts 277. The pair of bolts 277 pass through clear holes in the pair of top screw mounting plates 271 and thread into the ends of the top slide rod 275. A pair of bottom screw mounting plates 279L and 279R is fixedly attached to the inside lower surfaces of the pair of upright members 267L and 267R in the same manner as the pair of top screw mounting plates 271L and 271R. A bottom slide rod 281 is fixedly attached between the pair of bottom screw mounting plates 279L and 279R, likewise in the same manner as the top slide rod 275. The main hopper frame 263 heretofore described, provides a mounting structure for the main hopper 259.

The main hopper 259 comprises a top right hand adjusting mount plate 283 and a top left hand adjusting mount plate 285. Both of these plates are L-shaped; the top right hand adjusting mount plate 283 standing erect in FIG. 7 and the top left hand adjusting mount plate 285 inverted. A pair of slide collars 287L and 287R are fixedly attached to their respective mounting plates as can be seen in FIG. 6. The pair of slide collars 287L and 287R are laterally in line with each other and are slidably mounted on the top slide rod 275. A pair of adjusting nuts 289L and 289R are fixedly attached to the top left hand adjusting mount plate 285 and the top right hand adjusting mount plate 283 respectively. The right hand adjusting nut 289R is mounted above the right hand slide collar 287R. Conversely, the left hand adjusting nut 289L is mounted below the left hand slide collar 287L. The right hand adjusting nut 289R is threadably mounted on a top right hand screw 291 that is rotatably mounted at its ends in the pair of top screw mounting plates 271L and 271R. The left hand adjusting nut 289L is threadably mounted on a top left hand screw 293 that is rotatably mounted at its ends in the pair of top screw mounting plates 271L and 271 (see FIGS. 6 and 8). The right hand end of the top left hand screw 293 is of reduced diameter and extends through the right hand top screw mounting plate 271R and is provided with a left screw crank handle 295.

The main hopper 259 comprises a bottom mounting and screw assembly 297 that incorporates a bottom right hand adjusting screw 299, a bottom left hand adjusting screw 311, the bottom slide rod 281, the pair of bottom screw mounting plates 279L and 279R, a right hand mounting assembly 315 and a left hand mounting assembly 317. The arrangement of parts is identical to the top mounting and screw assembly heretofore described, but for one exception. The bottom right hand adjusting screw 299 extends through the right hand bottom screw mounting plate 279R and is provided with a smaller diameter extension 319 on the end thereof. A right screw crank handle 321 is fixedly attached to the end of the smaller diameter extension 319.

Manipulation of the left screw crank handle 295 moves the left side of the main hopper 259 in the lateral direction in the following manner. A top left hand sprocket wheel 323 is fixedly attached to the right hand side of the top left hand screw 293. Likewise, a bottom left hand sprocket wheen 325 is fixedly attached to the right hand side of the bottom left hand adjusting screw 311. A left hand adjusting chanin 327 connects around the top left hand sprocket wheel 323 and the bottom left hand sprocket wheel 325. Tension in the left hand adjusting chain 327 is provided by a right side tension sprocket 329 that is rotatably mounted to the right hand upright member 267R by means of a right side sprocket mount 331. As the left screw crank handle 295 is rotated, the top left hand screw 293 and the top left hand sprocket wheel 323 turns, moving the left hand adjusting chain 327 that rotates the bottom left hand sprocket wheel 325 and the bottom left hand adjusting screw 311. Consequently, the left hand adjusting nut 289L moves along the top left hand screw 293 as the left hand slide collar 287L slides along the top slide rod 275. Simultaneously, the left hand mounting assembly 317 moves laterally along the bottom mounting and adjusting assembly 297. Therefore, the left side of the main hopper 259 is moved laterally and retains its vertical disposition.

A left hand takeoff sprocket 333 is fixedly attached to the left side of the bottom left hand adjusting screw 311 (FIG. 6). A left side vertical transfer chain 335 extends downwardly and around a left side bottom sprocket 337 that is fixedly attached to a left side spindle 339. The left side spindle 339 is rotatably mounted in a left side spindle mount 341 that is in turn fixedly attached to the left hand upright member 267L. Also fixedly attached to the left side spindle 339 is a left side forward transfer sprocket 3341 that cooperates in transferring the left side adjustments to the pad chute assembly 163 by means of a left side horizontal transfer chain 343 that will be more fully described hereinafter.

Manipulation of the right screw crank handle 321 moves the right side of the main hopper 259 in the lateral direction in the following manner. A bottom right hand sprocket 347 is fixedly attached to the left side of the bottom right hand adjusting screw 299. Likewise, a top right hand sprocket wheel 349 is fixedly attached to the left side of the top right hand screw 291. A right hand adjusting chain 361 connects around the bottom left hand sprocket 347 and the top right hand sprocket wheel 349. Tension in the right hand adjusting chain 351 is provided by a left side tension sprocket 353 that is rotatably mounted to the left hand upright member 267L by means of a left side sproket mount 355 shown in FIGS. 6 and 7. As the right screw crank handle 321 is rotated, the bottom right hand adjusting screw 299 and the bottom left hand sprocket 347 turn, moving the right hand adjusting chain 351 that rotates the top right hand sprocket wheel 349 and the top right hand screw 291. Consequently, the right hand adjusting numb 289R moves along the top right hand screw 291 as the right hand slide collar 287R slides along the top slide rod 275. Simultaneously, the right hand mounting assembly 315 moves laterally along the bottom mounting and adjusting assembly 297. Therefore, the right side of the main hopper 259 is moved laterally and retains its vertical disposition. A right hand takeoff sprocket 357 is fixedly attached to the right side of the bottom right hand adjusting screw 299. A right side vertical transfer chain 359 extends downwardly and around a right side bottom sprocket 361 that is fixedly attached to a right side spindle 363. The right side spindle 363 is rotatably mounted in a right side spindle mount 365 that is in turn fixedly attached to the right hand upright member 267R. Also fixedly attached to the right side spindle 363 is a right side forward transfer sprocket 367 that cooperates in transferring the right side adjustments to the pad chute assembly 163 (FIG. 5) by means of a right side horizontal transfer chain 368 (FIG. 7) that will be more fully described hereinafter.

Figure 9:
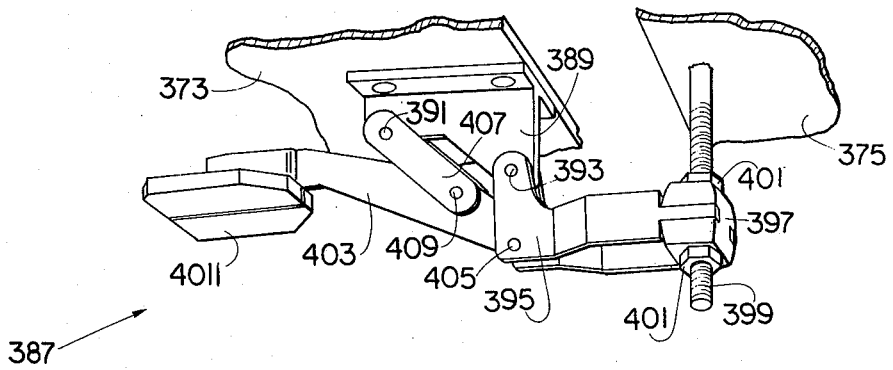
FIG. 9 is a fragmentary perspective view showing details of a latching mechanism of a first hooper of the device.

The main hopper assembly 165 comprises the main hopper 259 (FIGS. 6, 7 and 8). The main hopper 259 comprises a left side panel and backstop 369 (FIG. 8) fixedly attached to the inboard surface of the top left hand adjusting mount plate 285 and in the same manner to a plate 3285 (FIG. 6) of the left hand mounting assembly 317. A right side panel and backstop 371 incorporates a corner angle 373 fixedly attached to the inboard surface of the top right hand adjusting mount plate 283 and in a similar manner to a plate 3283 of the right hand mounting assembly 315. The right side panel and backstop 371 also incorporates a door 375 (FIGS. 7 and 8) that swings to the right by virtue of a pair of hinges 377 that are fixedly attached to the right hand adjusting mount plate 283 and in a similar manner to the plate 3283 of the right hand mounting assembly 315. Each of the pair of hinges 377 comprises a hinge base 379 fixedly attached to its respective adjusting mount plate by means of a pair of bolts 381 and hinge arm 383 pivotally attached to the hinge base 379, as can be seen in FIGS. 7 and 8. The hinge arm 383 is fixedly attached to the door 375 by means of a pair of bolts 385. The door is opened and locked shut by means of a lock assembly 387 as shown in detail in FIG. 9. The lock assembly 387 comprises a mount tee 389 fixedly attached to the corner angle 373. The mount tee 389 incorporates two pivots; a link pivot 391 and an arm pivot 393. The arm pivot 393 is set outwardly of the link pivot 391 as shown in FIG. 9. Pivotally attached to the arm pivot 393 is a door arm 395. The door arm 395 carries at its free end a grommet 397. The grommet 397 holds a door bolt 399 and is adjustable along the length of the door bolt 399 by means of a pair of set nuts 401. The door bolt 399 is rigidly affixed to the door 375. The arm pivot 393 is in line with the pivot axis of the pair of hinges 377 as shown in FIG. 7. The lock assembly 387 also incorporates a lock handle 4011 that is rigidly affixed to a handle arm 403. The handle arm 403 is pivotally attached to the door arm 395 by means of a handle pivot pin 405. A handle link 407 is pivotally attached to the handle arm 403 by means of an arm link pivot pin 409 at one end and to the link pivot 391 of the mount tee 389 at the other end. This four sided linkage locks the door 375 shut when the arm link pivot 409 passes the line between the link pivot 391 and the handle pivot pin 405. As the handle 4011 is pulled away from the corner angle 373, the handle pivot pin 405 will move clockwise in an arc about the arm pivot 393, swinging the door 375 clockwise and open so that the handle arm 403 and the door arm 395 become parallel when the door 375 is full open.

Figure 10:
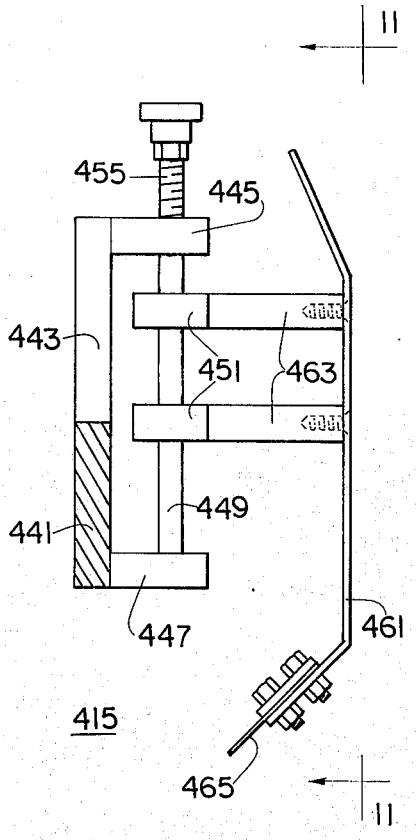
FIG. 10 is a view in side elevation of a discriminator support structure of the device, a brace which supports the structure being shown in section.
Figure 11:
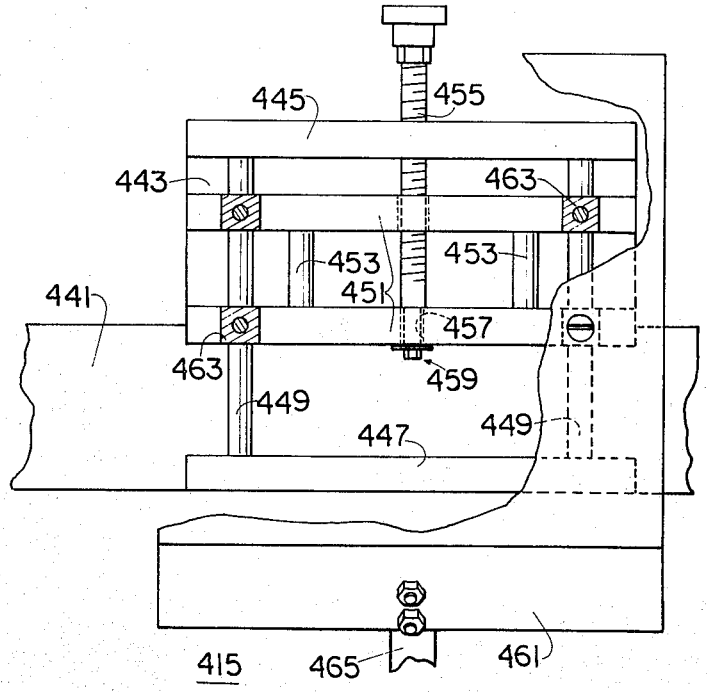
FIG. 11 is an end elevational view of the discriminator structure shown in FIG. 10 taken in the direction of the arrows 11—11 in FIG. 10, parts being broken away to reveal details of structure.

Pads 15 (FIG. 8) are stacked in the main hopper 259 manually and are fed in shingled or sequenced manner off the bottom of the stack of pads in the main hopper 259 and up the incline conveyor frame assembly 35 by means of the incline conveyor belt 229. As can be seen in FIG. 8, the incline conveyor belt 229 is mechanically supported by the input pulley 243 as previously described. The input pulley 243 is fixedly attached to an input spindle 411 that is rotatably mounted in a pair of input bearings 413. The pair of input bearings 413 are fixedly attached to the inboard surfaces of the pair of long slide rails 143L and 143R. As the pads 15 move from under the stack of pads and up the incline conveyor belt 229, the pads 15 pass under a main hopper discriminator assembly 415 as shown in FIGS. 5, 10, and 11.

The main hopper discriminator assembly 415 is comprised of a pair of discriminator outriggers 417 (FIG. 5) rigidly attached in a lateral disposition to the top end of the pair of output motor hangers 153. A pair of discriminator uprights 419 are fixedly attached to the infeed side and at the outer ends of the pair of discriminator outriggers 417. A discriminator output lateral brace 421 is fixedly attached across the top ends of the pair of discriminator uprights 419, and provides lateral spaced relationship thereto. Likewise, as shown in FIGS. 6, 7 and 8, a discriminator input lateral brace 423 is fixedly attached to the pair of upright members 267L and 267R and at the same elevation as the discriminator output lateral brace 421 with respect to the incline conveyor frame assembly 35. Rotatably mounted between the outer ends of the discriminator output lateral brace 421 and the discriminator input lateral brace 423 is a pair of long discriminator screws 425L and 425R. A right side discriminator sprocket 427 is fixedly attached to the input end of the right side long discriminator screw 425R. In identical manner, a left side discriminator sprocket 429 (FIGS. 6 and 8) is fixedly attached to the input end of the left side long discriminator screw 425L. Adjacent to the right hand side of and fixedly attached to the discriminator lateral brace 423 is a crank sprocket bearing mount 431. Rotatably mounted on the crank sprocket bearing mount 431 is a crank sprocket 433. A discriminator crank handle 435 is fixedly attached to the crank sprocket 433. A discriminator lateral chain 437 circumscribes the right side discriminator sprocket 427 and the left side discriminator sprocket 429. The discriminator lateral chain 437 passes from the bottom of the left side discriminator sprocket 429 to the bottom of the right side discriminator sprocket 427, counterclockwise around and over the top of the right side discriminator sprocket 427, then passes to the bottom of the crank sprocket 433 before returning to the top of the left side discriminator sprocket 429. In this manner, the crank sprocket 433 also functions as a tension sprocket for the discriminator lateral chain 437. As the discriminator crank handle 435 is turned, the discriminator lateral chain 437 rotates the pair of long discriminator screws 425L and 425R in unison, thereby moving a pair of discriminator adjusting nuts 439, one of which is shown in FIG. 8, longitudinally along the pair of long discriminator screws 425L and 425R. The pair of discriminator adjusting nuts 439 are rigidly held in fixed relationship to each other by means of a lateral mid brace 441. As shown in FIGS. 10 and 11, a discriminator vertical mount plate 443 is rigidly affixed to the top of and at the center of the lateral mid brace 441. A top discriminator mount plate 445 is fixedly attached in a horizontal plane at the top of the discriminator vertical mount plate 443. Similarly, a bottom discriminator mount plate 447 is mounted at the bottom edge of the lateral mid-brace 441. Referring to FIG. 11, a pair of discriminator slide rods 449 are fixedly and vertically mounted between the top discriminator mount plate 445 and the bottom discriminator mount plate 447. Slidably mounted thereon is a pair of plate slides 451 that are held in vertical and parallel spaced relationship by means of a pair of post spacers 453. A discriminator jack screw 455 is threadably mounted through the top discriminator mount plate 445, passes clear and through the top member of the pair of plate slides 451, and is rotatably restrained in a clear hole 457 of the bottom member of the pair of plate slides 457 by means of a bolt and washer combination 459. In this manner, the jack screw 455 governs the depth of a main hopper discriminator plate 461 as described hereafter.

A set of four discriminator plate mounts 463 are rigidly affixed to the pair of plate slides 451. The main hopper discriminator plate is fixedly attached to the set of four discriminator plate mounts 463 as shown in FIG. 11. A discriminator tongue 465 is fixedly clamped to the bottom of the main hopper discriminator plate 461 and extends toward the pad chute assembly 163 in a manner adjacent to the incline conveyor belt 229 as shown in FIG. 5. The discriminator tongue 465 continues to discriminate and smooth the pad flow from the main hopper assembly 165 and protects the pad shingle as the incline conveyor belt 229 delivers the pads into the pad chute assembly 163.

Figure 13:
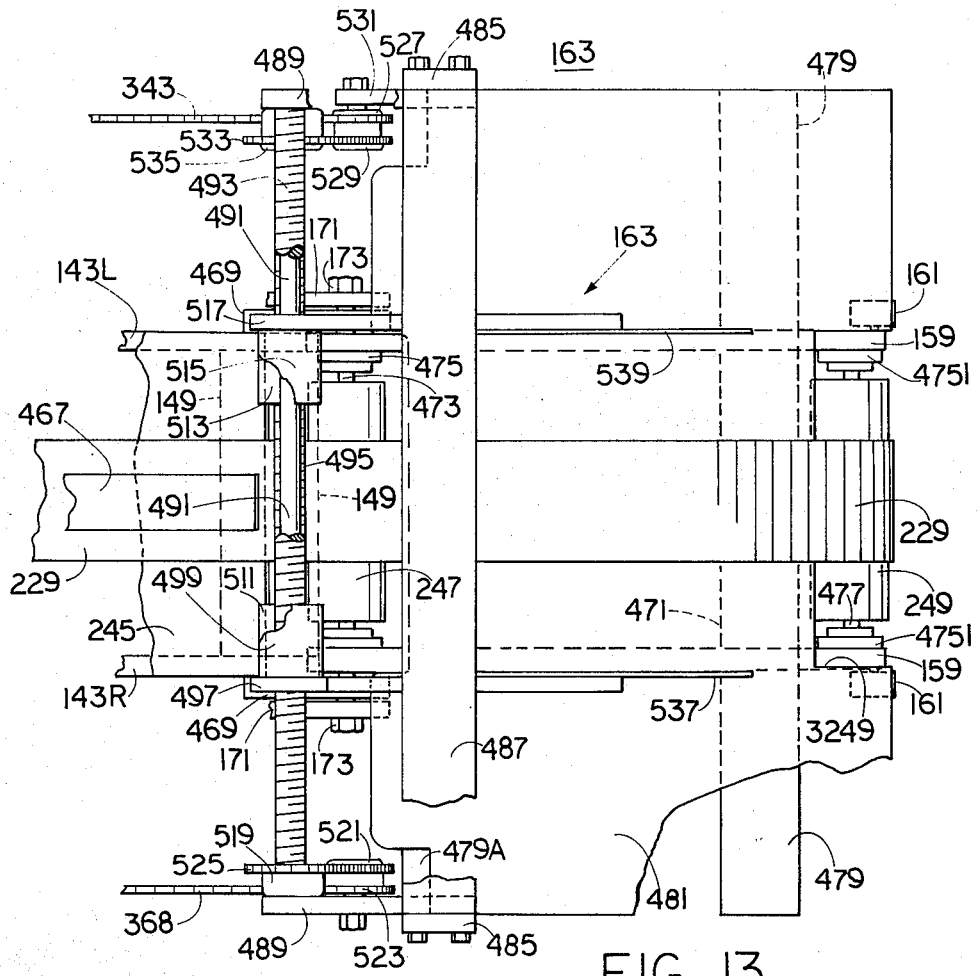
FIG. 13 is a view taken in the direction of the arrows 13—13 in FIG. 12.

The pad chute assembly 163 (FIGS. 12 and 13) is mounted on top of the pair of short booms 159. The pair of short booms 159 are pivotally attached to the pair of long slide rails 143L and 143R by means of the pair of bolts 173 as shown in FIG. 13. The upper ends of the pair of long slide rails 143L and 143R are held in lateral spaced relationship by means of the short rail 149 (FIG. 12) as previously described. A pair of pivot lugs 469 are rigidly affixed to the outboard surfaces and at the ends of the long slide rails 143L and 143R. The pair of bolts 173 pass through clear holes in the pair of main adjusting pivot arms 171, through the pair of pivot lugs 469 and threadably mount in the pair of short booms 159. The pair of short booms 159 are held in lateral spaced relationship by means of a top end spreader 471 (FIG. 13).

The top idler 247 is rigidly affixed to a top idler shaft 473 that is rotatably mounted in a pair of top roller bearings 475. The pair of top idler bearings 475 are fixedly attached to the inboard surfaces of the pair of short booms 159 and opposite the pair of bolts 173. At the free end of the pair of short booms 159 is a pair of end idler bearings 4751 that rotatably hold an end idler shaft 477. The end idler 249 is rigidly affixed to the end idler shaft 477.

A set of four outriggers 479 and 479A are rigidly affixed to the outboard surfaces of and near the ends of the pair of short booms 159 and extend laterally therefrom. The set of four outriggers 479 and 479A, in combination with the pair of short booms 159, function as mounting structure for a transfer plate 481. The transfer plate 481 extends from the output side of the top idler 247, down the pair of short booms 159, and wraps around and over the end of the pair of short booms 159 and terminates near the bottom edge of the pair of small rollers 161. The pair of small rollers 161 are rotatably mounted to the outboard surfaces of a pair of small roller mounts 483 that are in turn rigidly affixed to the bottom free end of the pair of short booms 159.

The incline conveyor belt 229 leaves the brace plate 245 and passes over the top idler 247, then downwardly over the transfer plate 481 to the end idler 249. As previously described, the incline conveyor belt 229 wraps clockwise around the end idler 249 to pass over the top of the bottom idler 251 in the opposite direction. As the belt 229 passes around the idler 249, it passes through a slot 3249 (FIG. 13) in the transfer plate 481.

A pair of chute uprights 485 are rigidly affixed at their bottom ends to the two outriggers 479A located near the bottom idler 251. The pair of chute uprights 485 is fixedly held in lateral spaced relationship by a chute cross bar 487. This rectangular structure forms the mounting structure for the pad chute assembly 163.

Figure 12:
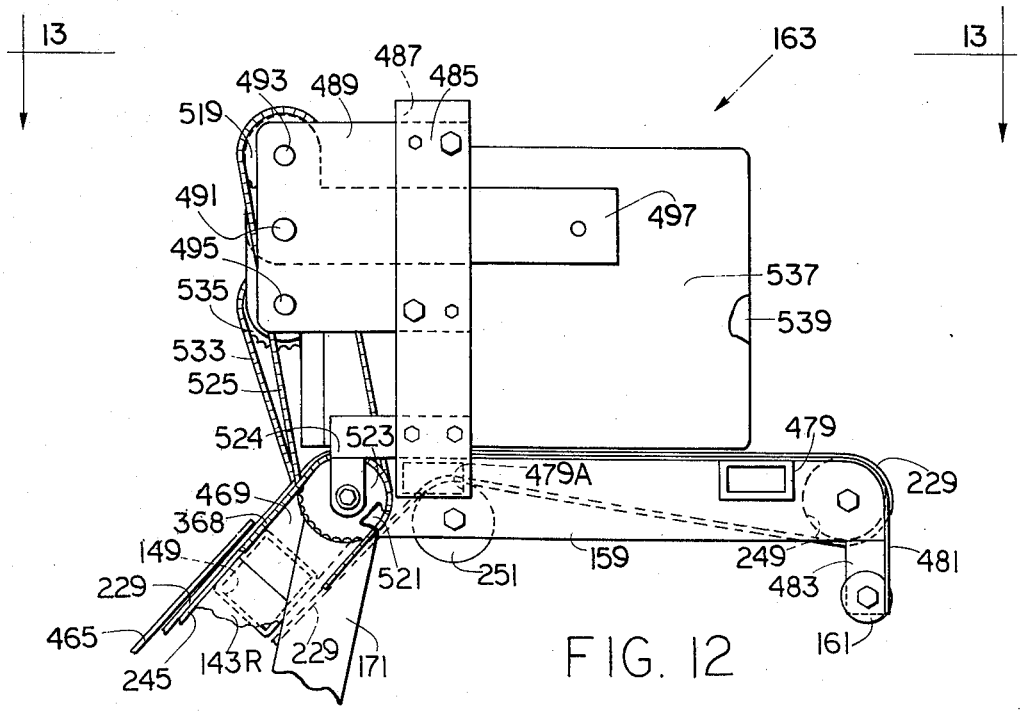
FIG. 12 is a view in side elevation of a delivery end portion of a first conveyor of the device.

The pad chute assembly 163 comprises a pair of long screw plates 489 fixedly attached to the inboard surface of the pair of chute uprights 485 adjacent to the chute cross bar 487. Fixedly attached between the pair of long screw plates 489 is a chute slide rod 491. A chute top adjusting screw 493 is rotatably mounted in the pair of long screw plates 489 above and parallel to the chute slide rod 491. In the same manner, a chute bottom adjusting screw 495 is rotatably held in the pair of long screw plates 489. A right hand chute adjusting mount plate 497 is movably mounted on the chute top adjusting screw 493 and the chute slide rod 491 by means of a right hand chute screw nut 499 and a right hand chute slide collar 511 fixedly attached thereto. In the same manner, a left hand chute adjusting mounting plate 517 is movably mounted on the chute bottom adjusting screw 495 and the chute slide rod 491 by means of a left hand chute screw nut 513 and a left hand chute slide collar 515 fixedly attached thereto. The chute slide collars 511 and 515 slide on the chute slide rod 491. Therefore, the right hand chute adjusting mount plate 497 and the left hand chute adjusting mount plate 517 are moved laterally in opposition to each other to adjust the width of the pad chute assembly 163 to accept any pad size. This adjustment is made in a manner similar to that previously explained with respect to the main hopper assembly 165 (see FIG. 6). A right hand chute adjusting sprocket 519 is rigidly affixed to the right hand end of the top adjusting screw 493 as seen in FIGS. 12 and 13. A right hand transfer sprocket 521 is rotatably attached to a right hand sprocket bracket 524 that is fixedly attached to the bottom inboard side of the right hand member of the pair of chute uprights 485. A right hand reverse transfer sprocket 523 is rigidly affixed to the right hand transfer sprocket 521 and accepts the right side horizontal transfer chain 368 that thereby transfers the right side main hopper adjustment movements to the right hand reverse transfer sprocket 523. The right hand reverse transfer sprocket 523 in turn delivers these same movements to the right hand chute adjustment sprocket 519 by means of a right hand vertical transfer chain 525. In the same manner, the left side horizontal transfer chain 343 (FIGS. 8 and 13), delivers left side main hopper adjustments to a left hand reverse transfer sprocket 527 (FIG. 13) that is rigidly mounted to a left hand transfer sprocket 529. The left hand transfer sprocket 529 and the left hand reverse transfer sprocket 527 are rotatably attached to a left hand sprocket bracket 531 that is in turn fixedly attached to the left hand member of the pair of chute uprights 485. Referring to FIG. 12, a left hand vertical transfer chain 533 couples the left hand transfer sprocket 529 to a left hand chute adjusting sprocket 535 that is rigidly affixed to the left side of the chute bottom adjusting screw 495. This imparts the same left side lateral adjusting movements to the pad chute assembly 163 as are imparted to the main hopper assembly 165. A right hand chute side plate 537 is fixedly attached to the inboard surface of the right hand chute adjusting mount plate 497. A left hand chute side plate 539 is fixedly attached to the inboard surface of the left hand chute adjusting mount plate 517. The pad chute assembly 163 accepts pads from the incline conveyor and guides a shingled procession of pads through the change of slope encountered as the incline conveyor belt 229 pases over the top idler 247 in preparation of dropping the pads 15 into the front hopper assembly 115 (FIGS. 5 and 15).

Figure 17:
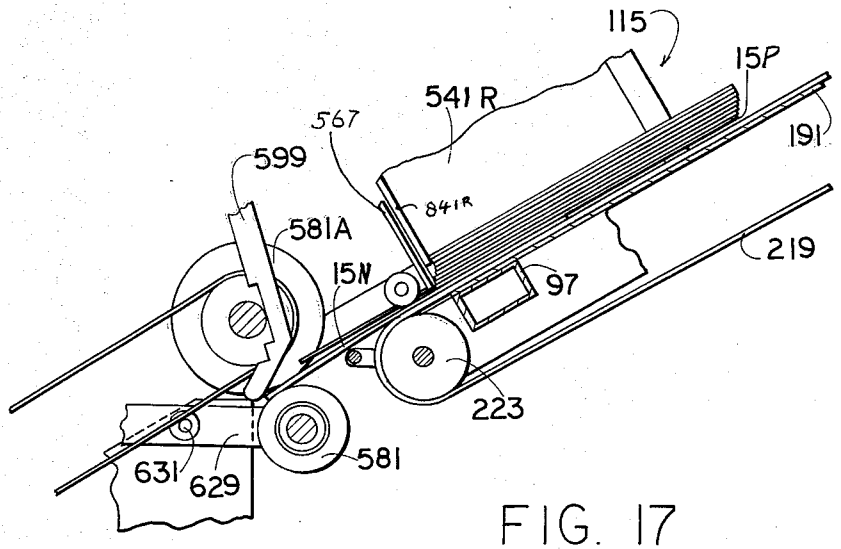
FIG. 17 is a fragmentary view in section taken on the same line as FIG. 15 but showing a movable nip roll assembly in pad engaging position.

The front hopper assembly 115 is shown in detail in FIGS. 14 and 15. The front hopper assembly 115 comprises a pair of front hopper side plates 541L and 541R that are fixedly attached to a pair of front hopper adjusting mount plates 543L and 543R, respectively. The front hopper adjusting mount plates 543 and therefore the pair of front hopper side plates 541 are moved laterally to accept various sizes of pads by virtue of a front hopper screw and rod assembly 545. Flanges 841L and 841R at edges of the mount plates 543L and 543R catch the pads as shown in FIG. 17 as the pads are projected from the pad chute assembly 163 (FIG. 5) into the front hopper assembly 115.

Mounting plates 4101 and 4102 (FIG. 14) are mounted on inner faces of the upright members 111. A slide rod 4103 spans the mounting plates 4101 and 4102. Upper and lower adjustment screws 4104 and 4106 are rotatably mounted in the plates 4101 and 4102 parallel to the slide rod 4103. A left side adjusting nut 4108 is threaded on the upper adjusting screw 4104 and a right side adjusting nut 4109 is threaded on the lower adjusting screw 4106. The right side adjusting nut 4109 is mounted on the mounting plate 543R and the left side adjusting nut 4108 is mounted on the mounting plate 543L. Guide slides 4111 and 4112 are slidably mounted on the slide rod 4103 and are mounted on the mount plates 543R and 543L, respectively. Cranks 4113 and 4114 are mounted on the screws 4104 and 4106, respectively, for turning the screws 4104 and 4106 to adjust the position of the side plates 541L and 541R.

The output roller 223 is rotatably mounted on an output shaft 546 (FIG. 15) that is fixedly mounted in the output end of the pair of nip conveyor booms 93L and 93R (See FIG. 14). Pivotally mounted on the output shaft 546 between the end of the pair of nip conveyor booms 93L and 93R and the output roller 223 is a pair of collars 547 incorporating a pair of lugs 549 and a crossbar 551. The crossbar 551 is fixedly attached between the pair of lugs 549 that are in turn rigidly affixed to the pair of collars 547. The crossbar 551 is adjustable in height by virtue of the pivotal mounting of the pair of collars 547 and provide an extended support for pads (as shown in FIG. 17) leaving the front hopper assembly 115. The top idle pulley 221 (FIG. 15) is rotatably mounted on a top idle shaft 553 (FIG. 14) that is mounted between the upper ends of the pair of nip conveyor booms 93L and 93R. The nip conveyor belt 219 passes over the top idle pulley 221, passes downwardly over the base plate 191 and counterclockwise around the output pulley 223 and over the top idle pulley 225 before returning to the drive drum 195 (FIG. 5) as has been previously described.

Figure 16:
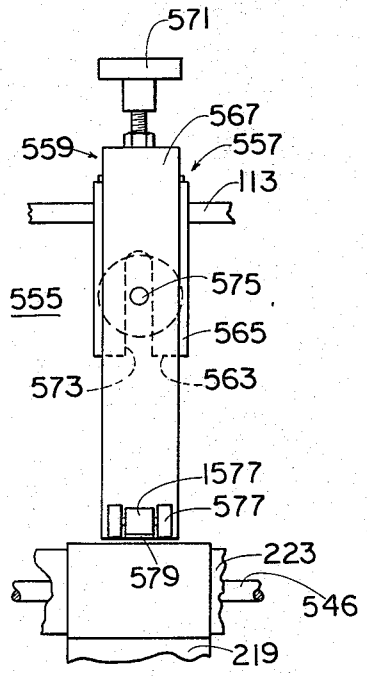
FIG. 16 is a fragmentary view of a second discriminator structure of the machine taken in the direction of the arrows 16—16 in FIG. 15.

Fixedly attached to the center of the spacer bar 113 (FIGS. 14, 15 and 16) is a front hopper discriminator assembly 555. The front hopper discriminator assembly 555 is comprised of a base weldment 557 and a gate weldment 559. The base weldment 557 incorporates a mount base 561 (FIG. 15) fixedly attached to an upright back 563. Rigidly affixed to both sides of the upright back 563 is a pair of retainer rails 565. The base weldment 557 is fixedly attached to the upright spacer 113 with the upright back 563 extending downwardly off the output edge of the upright spacer 113. The gate weldment 559 incorporates a discriminator gate 567 rigidly affixed to an elevation lug 569 so that the discriminator gate 567 lies between the pair of retainer rails 565. The elevation lug 569 is cantilever suspended above the mount base 561. The elevation lug 569 incorporates a jack screw and handle 571 for positioning the height of the gate weldment 559. A clear slot 573 (FIG. 16) is provided in the upright back 563 for the passage of a lock bolt and handle 575 that is threadably mounted in the discriminator gate 567. Friction and locking is thereby provided for the discriminator gate 567. The bottom of the discriminator gate 567 is provided with a pair of discriminator wheels 577 rotatably mounted on a block 1577 that is rigidly affixed to the discriminator gate 567. The bottom of the discriminator gate 567 also incorporates a tongue 579 that guides the pads into proper position with respect to a set of four nip wheels 581 and 581A. Also, a pair of side pad guides 583 (FIGS. 14 and 15) are fixedly attached to the outboard surfaces of the pair of front hopper adjusting mount plates 543 for lateral restraint of the pads 15.

A limit switch mount 585 is rigidly affixed in a vertical manner to the spacer bar 113. A limit switch LS-14 is fixedly attached to the right side of the plate 585, with a trip arm 587 hanging downward and approximately at the center of the belt 219 (FIG. 15). The limit switch LS-14 provides an electrical signal that indicates whether the front hopper assembly 115 is full.

A limit switch mount arm 589 is fixedly and cantilever mounted from the top of the upright spacer 113, and extends toward the bundle accumulator machine 10. A limit switch assembly LS-10-11 is mounted in a housing 591 that is fixedly attached to an edge of the mount plate 589 as shown in FIGS. 14 and 15. A clamp plate 593 (FIG. 14) incorporates four long bolts 595 that reach across the width of the mount plate 593 and fixedly hold the housing 591 in position adjacent and above aa nip roll drive belt 597. The housing 591 carries a trip arm 599 that extends downwardly and indicates when a pad is in position for transfer to the bundle accumulator machine 10.

As has been described in the aforementioned copending application Ser. No. 476,578, cartons are processed in a shingled fashion from a gluer/sealer machine, through the bundle accumulator machine 10 (FIG. 1A), and into a cassette receiver 18 of a bundle overwrap machine.

An incline conveyor 74 (FIG. 15) carries a shingled procession of cartons between its paired belts 74A and 74B to a count section 76 where the cartons pass over a count switch 78 located between pairs of count rollers 80. A carry-off conveyor 82 removes the counted cartons from the counting section 76 and feeds them into the throats of pairs of acceleration wheels 84 and 84H. This combination of machinery quickly removes the cartons from the counting section 76. The carry-off conveyor 82 runs considerably faster than does the incline conveyor 74. During the packing cycle of the bundle accumulator machine 10, the incline conveyor 74 and count section 76 can be stopped at a proper signal to govern the number of cartons reaching the stacking assembly 52.

At the time a count has been made, the incline conveyor 74 and the count section 76 are stopped. A timed delay permits the last carton that has emerged from the count section 76 to reach the stacking assembly 52. As the time delay runs out, a nip signal is given. A cylinder 615, rotatably mounted by a pin 617, retracts a cylinder arm 619. The pin 617 is carried by a lug 1617 attached to the elevator stringer 50R. A clevis member 621 is slidably mounted on the cylinder arm 619 and is engageable with a collar 1619 mounted on the cylinder arm. A compression shock spring 623 (FIG. 15) bears on the clevis member 621 and on a shock spring retainer assembly 625 which is fixedly attached to the upper end portion of the cylinder arm 619. Trunnions 1625 carried by the clevis member 62 pivotally support a clevis yoke 627. Fixedly mounted to the clevis yoke 627 is a shaft pivot arm 629 that is pivotally mounted by means of a pivovt pin 631 to a nip assembly mount 633. The lower end of the shaft pivot arm 629 rotatably holds the right hand extremity of a lower nip shaft 635. The left hand extremity of the lower nip shaft 635 is pivotally mounted in a left side shaft pivot arm 637 (FIG. 14) that is pivotally mounted by means of a left side pin 639 to a left side nip assembly mount 641. Therefore, as the cylinder arm 619 retracts, the lower nip shaft 635 is rotated counterclockwise upward to the position shown in FIG. 17, which closes the set of four nip wheels 581 and 581A upon a pad 15N that is waiting at the output section of the pad inserter machine 11. The pad 15N is rapidly removed from the pad inserter machine 11 and thrown into the throat of the pairs of acceleration wheels 84 and 84H (FIG. 15) and thereby delivered into the stacking assembly 52 (FIG. 1).

As the pad (not shown in FIGS. 14 and 15) leaves the front hopper assembly 115, the trip arm 599 rotates counterclockwise from the position 559A of FIG. 15 to the position shown in full lines at 599 in FIG. 15 through action of spring means (not shown) to actuate the limit switch assembly LS-10-11. The limit switch assembly LS-10-11 makes a circuit (not shown in detail) which causes the motor and belt assembly 199 to move the nip conveyor belt 219 counterclockwise, thereby delivering another pad 15P (FIG. 17) from under the front hopper discriminator assembly 555 to the entrance of the set of four nip rolls 581 and 581A. At the same time, the limit switch assembly LS-10-11 makes a circuit (not shown in detail) which releases the cylinder 615 (FIG. 15) thereby opening the set of four nip rolls 581 to prevent non-sequential feed of additional pads. As the trip arm 599 recycles in the clockwise direction because another pad is being fed toward the set of four nip wheels 581, the trip arm 599 again makes the limit switch assembly LS-10-11, thereby stopping the nip conveyor belt 219 and resetting the nip wheel release cycle.

The nipped pad passes from the acceleration wheels 84 into a stacking section of the machine 10 which can be of the type as described in the aforementioned copending application Ser. No. 476,578.

As the pads of the stacks of pads in the front hopper assembly 115 are discharged, the trip arm 587 of the limit switch LS-14 swings downwardly to the FIG. 15 position, and the limit switch LS-14 actuates an appropriate circuit (not shown in detail) to cause advance of the belt 229 (FIG. 5) to cause delivery of pads to the front hopper assembly 115 until the trip arm 587 (FIG. 15) is raised by pads in the front hopper assembly 115.

The pad delivering device maintains a stack level in the second or front hopper 115 which is constant so that pads can be withdrawn therefrom in a uniform manner by the nip or second conveyor belt 219. Swinging of the crank arms 171 (FIG. 5) makes it possible to adjust the distance between the discharge end of the first or incline conveyor belt 229 and the second hopper 115 so that the pads are properly discharged from the second hopper.

The pad delivery machine illustrated in the drawings and described above is subject to structural modification without departing from the spirit and scope of the appended claims.

Having described my invention, what I claim as new and desire to secure by letters patent is:

1. A device for delivering pads to a machine for bundling flat articles which comprises a first pad hopper, a first conveyor which draws pads from the first pad hopper, a second pad hopper receiving pads from the first conveyor, a second conveyor for withdrawing pads from the second pad hopper, a first conveyor drive for driving the first conveyor, a second conveyor drive for driving the second conveyor, a main frame, a boom mounted on the main frame, a discharge belt supporting frame mounted on the boom and extending therefrom in the direction of pad discharge into the bundling machine, means for supporting the second hopper on the discharge belt supporting frame, the second conveyor being supported on the discharge belt supporting frame, a crank means pivotally mounted on the boom spaced from the discharge belt supporting frame, a sliding frame pivotally connected to the crank means, a support foot means slideably mounted on the main frame for substantially horizontal movement, an auxiliary frame pivotally mounted on the sliding frame adjacent the crank pivot thereof, means for supporting a free end of the auxiliary frame above the discharge belt supporting frame adjacent to the second hopper, the first conveyor traveling on the sliding frame and on the auxiliary frame to carry pads from the first hopper to be projected from the free end of the auxiliary frame into the second hopper, means for swinging the crank to advance the auxiliary frame toward and away from the second hopper, means for energizing the first conveyor drive when the level of pads in the second hopper falls below a predetermined level, switch means for energizing the second conveyor drive, a switch operator connected to the switch means and extending into the path of pads being advanced from the second hopper by the second conveyor, the switch operator actuating the switch means to disable the second conveyor drive when a pad has been advanced to a predetermined pad delivery position, and means for withdrawing the pad from the pad delivery position when a pad is required by the bundling machine and for delivering the pad to the bundling machine.

2. A device as in claim 1 wherein the support foot means is pivotally mounted on the sliding frame.

3. A device as in claim 1 wherein there is spring means interconnecting the sliding frame and the main frame and urging the sliding frame in a direction to withdraw the auxiliary frame from the second hopper.

4. A device as in claim 1 wherein the first pad hopper is mounted on the sliding frame, the sliding frame extends upwardly and toward the direction of pad discharge from the first pad hopper to the auxiliary frame and the auxiliary frame extends downwardly and toward the direction of pad discharge from the sliding frame, the first conveyor belt advancing pads from the first pad hopper upwardly along the sliding frame and then downwardly along the auxiliary frame to be discharged from the lower end of the auxiliary frame into the second pad hopper.

5. A device as in claim 4 wherein there are side guides mounted on the auxiliary frame and extending upwardly therefrom on opposite sides of the path of the pads for guiding the pads as the pads change direction of flow as the first conveyor belt passes from the sliding frame to the auxiliary frame.

6. A device as in claim 5 wherein the first pad hopper includes side walls for engaging edges of pads stacked in the first pad hopper and there is means for moving the side walls and the guides inwardly and outwardly in unison to adjust the space therebetween.

7. A device for delivering pads to a machine for bundling flat articles which comprises a pad hopper, means for guiding a conveyor belt under the pad hopper, the conveyor belt supporting a stack of pads in the pad hopper, means for delivering pads into the pad hopper on top of the stack of pads therein, means for stopping pads on the stack as they are delivered into the pad hopper, a discriminator having a lower edge terminating spaced above the conveyor belt a sufficient distance to permit a pad to pass thereunder, means for arresting the pad delivering means when the stack of pads reaches a predetermined height, means for advancing the conveyor belt to advance the lowermost pad in the stack under the discriminator, a switch actuator in the path of the lowermost pad, means controlled by the switch actuator for arresting advance of the conveyor belt when the lowermost pad has been advanced to a predetermined position in engagement with the switch actuator, and means for removing the lowermost pad when required, the switch actuator returning to a position at which the conveyor belt is advanced when the switch actuator is released.

* * * * *